United States Patent [19]

Jones

[11] 4,156,514

[45] May 29, 1979

[54] CYLINDER SUPPORT ASSEMBLY

[75] Inventor: Larry R. Jones, Norwalk, Calif.

[73] Assignee: The United States of America as represented by the Secretary of the Air Force, Washington, D.C.

[21] Appl. No.: 889,468

[22] Filed: Mar. 23, 1978

[51] Int. Cl.[2] ..... E21F 17/02

[52] U.S. Cl. ..... 248/58; 248/62

[58] Field of Search ..... 248/54 R, 58, 60, 62, 248/74 R, 74 A, 74 B, 358 A

[56] References Cited

U.S. PATENT DOCUMENTS

| | | | |
|---|---|---|---|
| 285,748 | 9/1883 | Gulick | 248/62 |
| 1,187,587 | 6/1916 | White | 248/62 |
| 2,489,481 | 11/1949 | Chester | 248/54 R |
| 3,141,642 | 7/1964 | Mayrath | 248/74 B |

FOREIGN PATENT DOCUMENTS

| | | | |
|---|---|---|---|
| 1299471 | 7/1969 | Fed. Rep. of Germany | 248/62 |
| 1375626 | 9/1964 | France | 248/358 A |
| 303429 | 8/1968 | Sweden | 248/358 A |

*Primary Examiner*—Robert A. Haber

*Attorney, Agent, or Firm*—Joseph E. Rusz; Arsen Tashjian

[57] ABSTRACT

The assembly releasably holds a hollow cylinder, or the like, from an overhead support in a stable condition, even during and after the hanging cylinder has expanded lengthwise. The preferred embodiment of the assembly includes: a first half-ring shaped member of sheet metal attached to the overhead support; a second half-ring shaped member of sheet metal disposed along, and in abutting contact with, the upper external surface of, the cylinder; a band clamp encircling and clamping the second half-ring member to the cylinder; and, a wire rope cable that is connected alternately, and recurringly, to the first and second half-ring members. The assembly is simple in structure, light in weight, and inexpensive to fabricate and to install.

2 Claims, 4 Drawing Figures

CYLINDER SUPPORT ASSEMBLY

STATEMENT OF GOVERNMENT INTEREST

The invention described herein may be manufactured and used by or for the Government for governmental purposes without the payment of any royalty thereon.

BACKGROUND OF THE INVENTION

This invention relates to a holding and supporting means and, more particularly, to such a means which is adapted for use in suspending and supporting a hollow cylinder (e.g., a duct, a pipe, or the like) in both the lateral and vertical axes, and in a balanced (i.e., stable) condition under a support which is in an overhead positional relationship to the cylinder, even if and when the held and supported cylinder expands along its longitudinal axis (i.e., its long axis).

Holding and supporting means for cylinders and the like are very well known. Also well known is the fact that such means, particularly of the hanging variation, are invariably heavy in weight, are expensive to fabricate and install, and are relatively complex in structure.

I have invented a unique holding and supporting means in the structural form of a "cradle" (hereinafter referred to as a "cylinder support assembly") that, unlike the prior art, is simultaneously light in weight, is inexpensive to fabricate and to install, and is simple in structure.

Thereby, I have significantly advanced the state-of-the-art.

SUMMARY OF THE INVENTION

This invention pertains to a novel cylinder support means that is light in weight, is inexpensive to fabricate and to install, is simple in structure, and, as importantly, allows expansion of the cylinder lengthwise (i.e., along its longitudinal, and long, axis).

Accordingly, the principal object of this invention is to teach the structure of such a novel cylinder support means.

This principal object, as well as other related objects, of this invention will become readily apparent after a consideration of the description of my invention cylinder support means, together with reference to the Figures of the drawings.

DESCRIPTION OF THE PREFERRED EMBODIMENT

Figure 1:
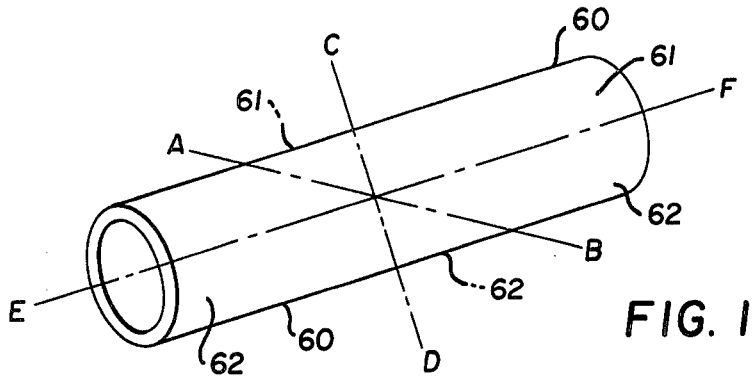
FIG. 1 is a perspective view, in simplified form, of a representative cylinder, or the like, to be supported and held with and by my invention.
Figure 3:
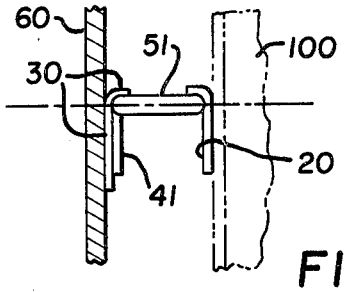
FIG. 3 is a bottom view, in simplified form, as seen along line 3—3 of FIG. 2, of a portion of my invention in its working environment.
Figure 2:
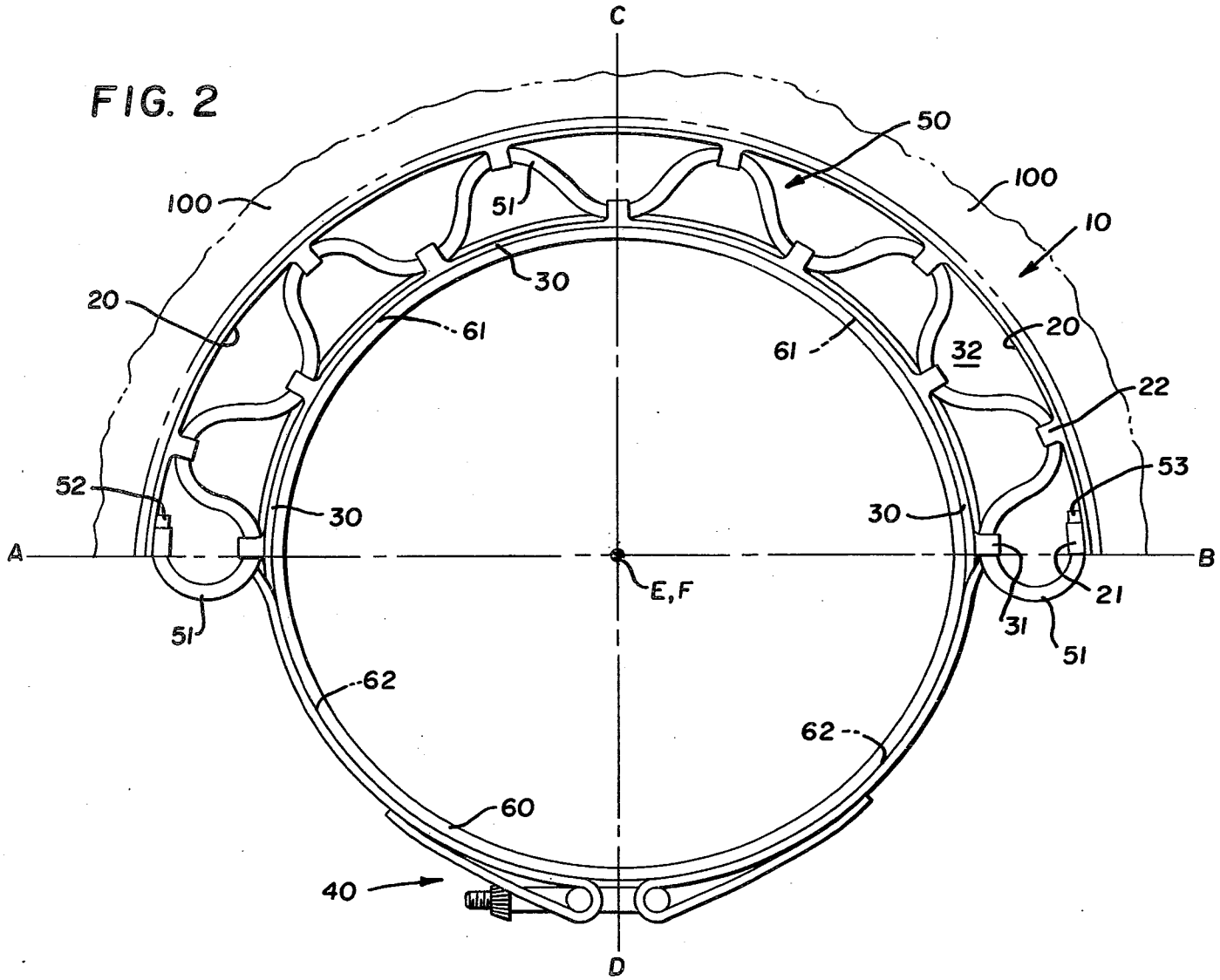
FIG. 2 is a front view, in simplified pictorial and schematic form, and partially in cross section, of my invention in its working environment.

With reference to FIGS. 1-3, inclusive, therein is shown a preferred embodiment 10 (or portion thereof) of my invention, a cylinder support assembly.

It is to be noted and remembered that the preferred embodiment 10 of my invention is adapted for use with an overhead support, such as 100, FIGS. 2 and 3, and concurrently for use in suspending and supporting a hollow cylinder, such as 60, FIGS. 1-3, inclusive, or the like (e.g., a duct or pipe) as to both its lateral (i.e., transverse) axis A—B, FIGS. 1 and 2, and in a balanced (i.e., stable) condition or position under the overhead support 100, even in the event that the held and supported cylinder 60 expands along its longitudinal axis (i.e., its long axis) E—F, FIGS. 1 and 2.

It is also to be noted that the hollow cylinder 60, FIGS. 1-3. exclusive, has an upper external surface 61, FIGS. 1 and 2, and a lower external surface 62, FIGS. 1 and 2.

Figure 4:
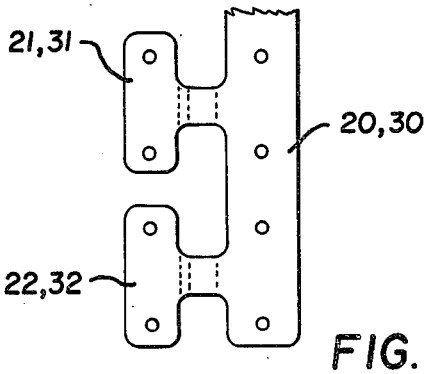
FIG. 4 is a top view, in simplified form and partially fragmented, of a representative portion (in a flat pattern) of one of two similar components of my invention.

In the most basic and generic structural form, my inventive cylinder support assembly 10 comprises: a first member 20, FIGS. 2, 3, and 4, in the shape of one half of a ring, that is attached to the overhead support 100, FIGS. 2 and 3; a second member 30, FIGS. 2, 3, and 4, also in the shape of one half of a ring, that is disposed along, and is in abutting contact with, the upper external surface 61, FIG. 2, of the cylinder 60; means, generally designated 40, FIG. 2, for releasably holding the second half-ring member 30 in abutting contact with the upper external surface 61 of the cylinder 60; and, means, generally designated 50, FIG. 2, for releasably hanging the second half-ring member 30 (and, of course, cylinder 60) from, and below, the first half-ring member 20, FIG. 2.

The first and second half-ring members 20 and 30, FIGS. 2, 3, and 4, are made preferably of sheet metal, and each half ring member 20 and 30 has a plurality of tabs (such as 21 and 22 for member 20, and 31 and 32 for member 30, FIG. 4) that are bendable over to form guides or holders, as shown in FIG. 2.

The means 40 for releasably holding the second half-ring member 30 in abutting contact with the upper external surface 61 of the cylinder 60 preferably includes a band clamp 41, FIGS. 2 and 3, surrounding (i.e., encircling), and disposed in abutting contact with, the second half-ring member 30 and the lower external surface 62 of the cylinder 60.

The means 50 for releasably hanging the second half-ring member 30 from, and below, the first half-ring member 20 includes a rope, preferably a wire rope cable 51, FIGS. 2 and 3, that is disposed in such a manner (or arrangement) that the cable 51 is connected alternately, and recurringly, to the second half-ring member 30 and to the first half-ring member 20, as shown in FIG. 2.

The connection of the cable 51 to half-ring members 20 and 30 is preferably by way of, and with, the plurality of tabs, such as 21, 22, 31 and 32, of the half-ring members that are bent over, as is shown in FIG. 2.

The cable 51 has a first end 52 and a second end 53, FIG. 2, with each end removably secured to the first ring member 20, as is shown in FIG. 2. The securing of each end 52 and 53 of cable 51 is accomplished by suitable means, such as by holders 23 and 24 and/or by being swaged.

MANNER OF OPERATION AND USE OF THE PREFERRED EMBODIMENT

The manner of operation and use of the preferred embodiment 10, FIG. 2, of my invention can be very easily ascertained by any person of ordinary skill in the art from the foregoing description, coupled with reference to the Figures of the drawings, particularly FIG. 2.

For others, it is sufficient to say in explanation that with and by the use of my cylinder support assembly 10, a hollow cylinder, such as 60, FIG. 1, may be releasably hung in a stable condition from, and below, an overhead support, such as 100, FIG. 2, and that the cylinder, while suspended and held by my assembly 10, will continue to remain in a stable condition during and after the cylinder has expanded along its longitudinal axis E—F, FIGS. 1 and 2.

CONCLUSION

It is abundantly clear from all of the foregoing, and from the Figures of the drawings, that the stated desired principal object, as well as other related objects, of the invention have been achieved.

It is to noted that, although there have been described the fundamental and unique features of my invention as applied to a preferred embodiment, various other embodiments, variations, adaptations, substitutions, additions, omissions, and the like, may occur to, and can be made by, those of ordinary skill in the art, without departing from the spirit of my invention.

What is claimed is:

1. A cylinder support assembly, adapted for use with an overhead support and with a hollow cylinder having an upper external surface, a lower external surface, a lateral axis, a vertical axis, and a longitudinal axis, wherein said cylinder may expand along said longitudinal axis, and wherein said cylinder is to be releasably hung in a stable position from, and below, said support and is to continue to remain in said stable position during and after said expansion of said cylinder along said longitudinal axis thereof, comprising:

a. a first member in the shape of one half of a ring attached to said overhead support and having a plurality of tabs that are bent over to form guides;

b. a second member in the shape of one half of a ring disposed along, and in abutting contact with, said upper external surface of said cylinder, and having a plurality of tabs that are bent over to form guides;

c. means for releasably holding said second half-ring member in abutting contact with said upper external surface of said cylinder, wherein this said means includes a band clamp surrounding, and disposed in abutting contact with, said second half-ring member and said lower external surface of said cylinder;

d. and, means for releasably hanging said second half-ring member from, and below, said first half-ring member, wherein this said means includes a wire rope cable that is disposed such that said cable is connected alternately to said second half-ring member by and through said plurality of tabs of said second half-ring member that are bent over to form guides, and to said first half-ring member by and through said plurality of tabs of said first half-ring member that are bent over to form guides, and wherein said wire rope cable has a first end and a second end, with each said end removably secured to said first half-ring member.

2. A cylinder support assembly, as set forth in claim 1, wherein said first half-ring member and said second half-ring member are made of sheet metal.

* * * * *